US007861729B2

(12) United States Patent
Zephyr et al.

(10) Patent No.: US 7,861,729 B2
(45) Date of Patent: Jan. 4, 2011

(54) HAIR WEAVE FOUNDATIONS AND METHODS OF USE

(76) Inventors: Wilise Zephyr, 3636 16th St. NW., Suite B-510, Washington, DC (US) 20010; Jose A. Zephyr, 3636 16th St. NW., Suite B-510, Washington, DC (US) 20010; Marie L. Zephyr, 3636 16th St. NW., Suite B-510, Washington, DC (US) 20010

( * ) Notice: Subject to any disclaimer, the term of this patent is extended or adjusted under 35 U.S.C. 154(b) by 472 days.

(21) Appl. No.: 12/077,497

(22) Filed: Mar. 18, 2008

(65) Prior Publication Data

US 2009/0235948 A1 Sep. 24, 2009

(51) Int. Cl.
*A41G 3/00* (2006.01)
*A41G 5/00* (2006.01)

(52) U.S. Cl. ..... 132/53; 132/201

(58) Field of Classification Search ..... 132/53–56, 132/201

See application file for complete search history.

(56) References Cited

U.S. PATENT DOCUMENTS 5,855,211 A * 1/1999 Nelson ..... 132/53
5,979,462 A 11/1999 Jones
5,992,424 A 11/1999 Repsha et al.
6,561,197 B2 5/2003 Harrison
6,883,525 B2 * 4/2005 Lee et al. ..... 132/53
2002/0166565 A1 11/2002 Whitfield
2004/0079382 A1 4/2004 Profitt-Campbell
2006/0065281 A1 3/2006 Kim
2007/0227549 A1 * 10/2007 Lee ..... 132/53

* cited by examiner

*Primary Examiner*—Robyn Doan
(74) *Attorney, Agent, or Firm*—Raymond Sun

(57) ABSTRACT

A hair piece to be attached to the head of a user, the hair piece having a cloth-based foundation having a top edge, a bottom edge, a left edge and a right edge, with the foundation including a middle slit provided at about the center of the foundation, a bottom slit provided adjacent the bottom edge, a first set of side slits provided along the left edge, a second set of side slits provided along the right edge, a first set of rubber bands provided along the left edge, a second set of rubber bands provided along the right edge, a third set of rubber bands provided along the top edge, a fourth set of rubber bands provided along the bottom edge, a fifth set of rubber bands provided about the middle slit, and a plurality of wefts of hair attached to the foundation.

9 Claims, 7 Drawing Sheets

HAIR WEAVE FOUNDATIONS AND METHODS OF USE

BACKGROUND OF THE INVENTION

1. Field of the Invention

The present invention relates to hair pieces, and in particular, to various hair pieces and methods for attaching the hair pieces to the head.

2. Description of the Prior Art

Many women with long, full hair still choose to use ponytails or other extension weaves to enhance the look of their hair. Other women prefer just a slight change, with perhaps a few extra inches in length of the hair to transform their normal daily appearance.

Unfortunately, many of the hair pieces and hair extensions that are currently available in the marketplace are not suited for a variety of different types of hair, or require the user to spend a lot of time to attach and use the hair piece or hair extension.

Thus, there remains a need to provide an improved hair piece, and method of attaching the hair piece to the head, which is convenient to use, and which allows for attachment within a short period of time.

SUMMARY OF THE DISCLOSURE

The present invention provides a hair piece, and a method of attaching the hair piece to the head of a user. The hair piece has a cloth-based foundation having a top edge, a bottom edge, a left edge and a right edge, with the foundation including a middle slit provided at about the center of the foundation, a bottom slit provided adjacent the bottom edge, a first set of side slits provided along the left edge, a second set of side slits provided along the right edge, a first set of rubber bands provided along the left edge, a second set of rubber bands provided along the right edge, a third set of rubber bands provided along the top edge, a fourth set of rubber bands provided along the bottom edge, a fifth set of rubber bands provided about the middle slit, and a plurality of wefts of hair attached to the foundation. According to the method, the user's hair is sectioned into a plurality of sections, the hair piece is then applied to the head, the rubber bands of the upper half of the first and second sets of rubber bands, and in the third set of rubber bands, are tied to a tiny strand of hair from the corresponding section of hair, the section of hair which will remain underneath the hair piece is pulled out of the middle slit, then the rubber bands in the lower half of the first and second sets, and in the fifth set, of rubber bands are tied to a tiny strand of hair from the corresponding sections of hair. Thereafter, the fourth set of rubber bands are tied to the strands of hair from the corresponding section of hair, and the sections of natural hair are blended with the hair piece.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
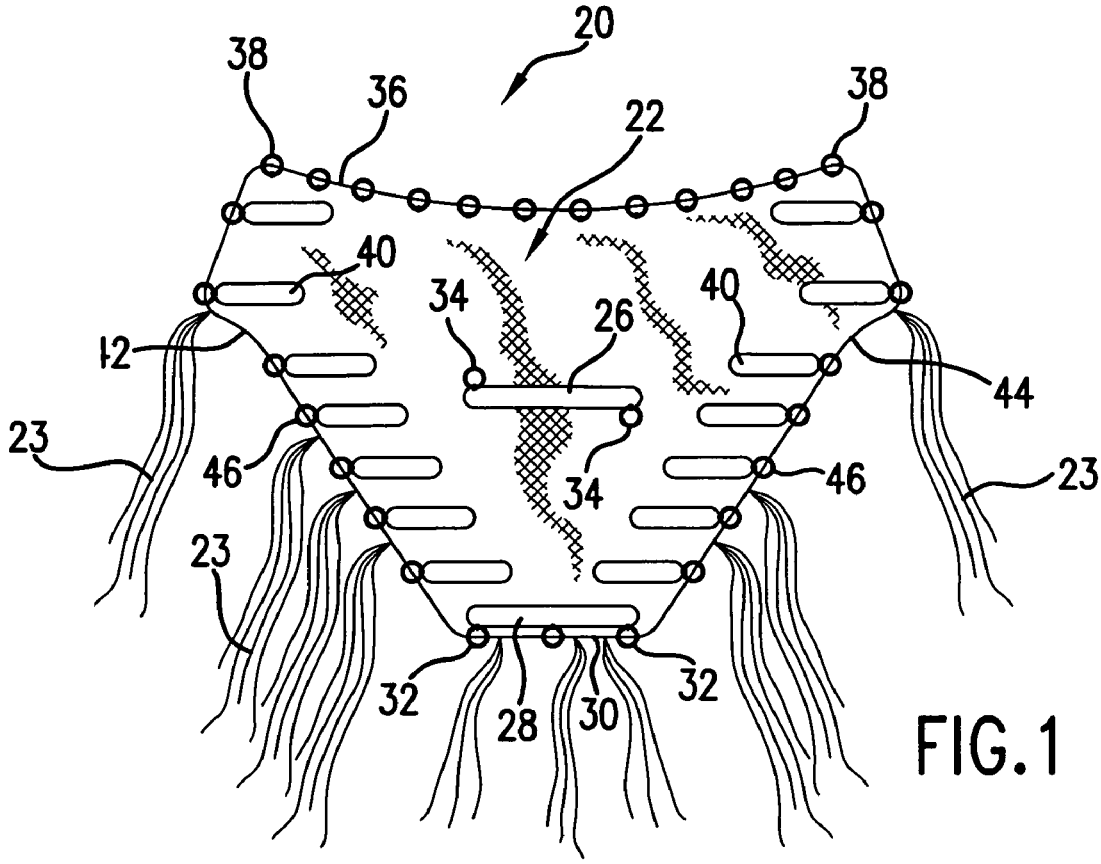
FIG. 1 is a front plan view of a hair piece according to one embodiment of the present invention.
Figure 2:
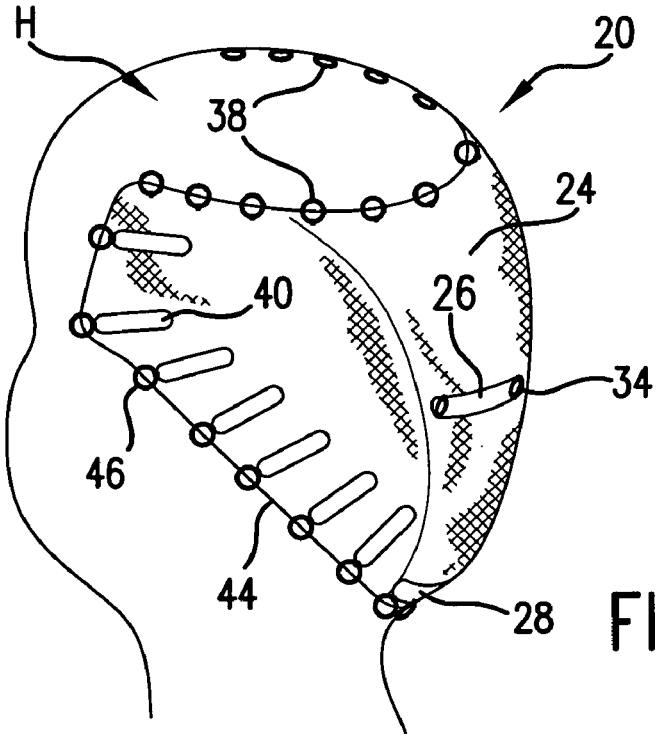
FIG. 2 illustrates the hair piece of FIG. 1 attached on a head, with the wefts of hair being omitted.
Figure 3:
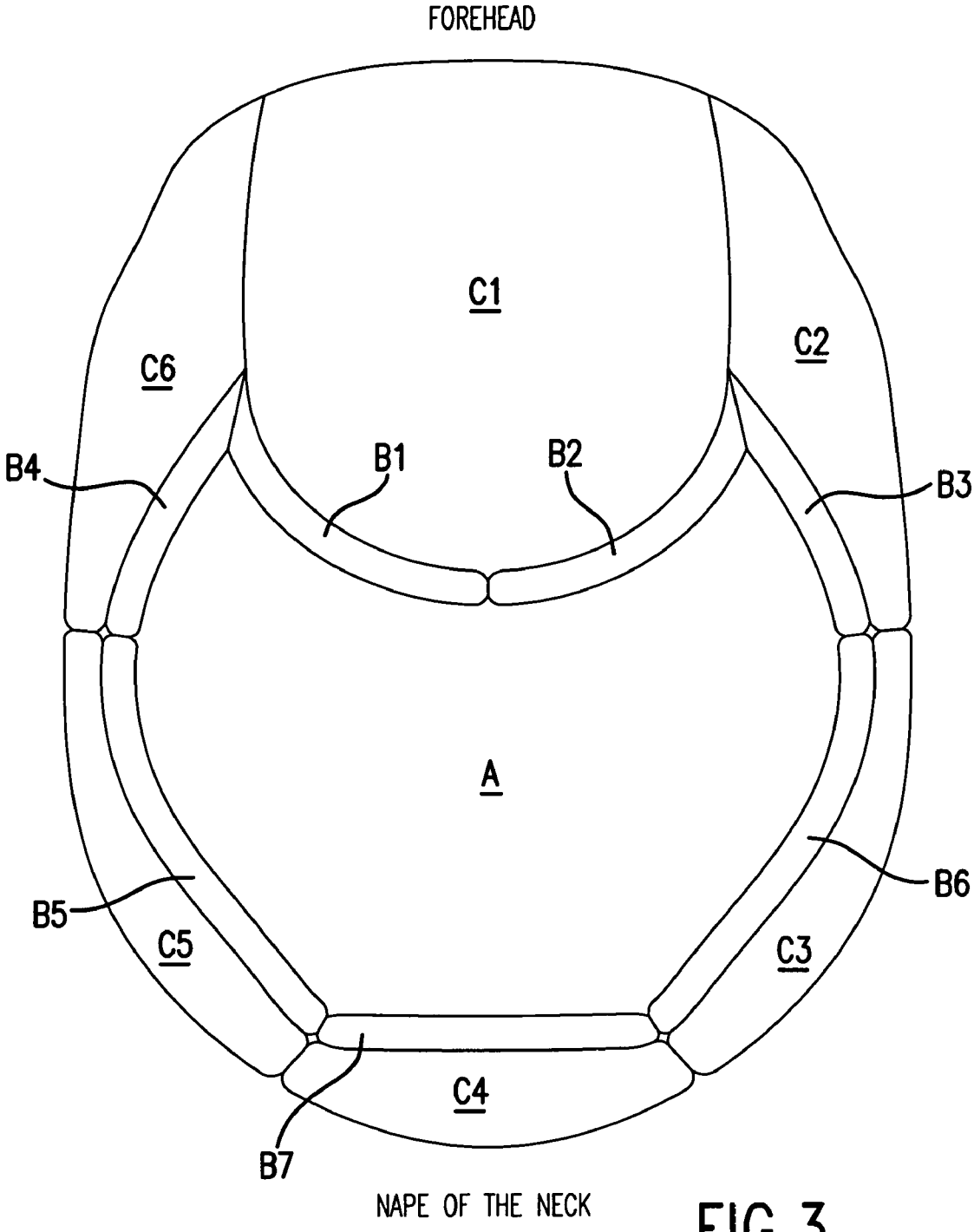
FIG. 3 is a schematic view of a head showing a plurality of sections of the user's hair to position the hair piece of FIG. 1.

FIGS. 1-3 illustrate one embodiment of a hair piece according to the present invention. The hair piece 20 has a foundation 22 that has a U-shape. The foundation 22 can be a thin, stretched and nested nylon cloth that is shaped to fit the rear and part of the left and right sides of the head H. The rear side 24 of the cloth foundation 22 has two elongated slits 26 and 28, each of which has a width or length of about 70 mm, and a height of about 10 mm. A bottom slit 28 is located adjacent the bottom edge 30, and a middle slit 26 is located at about the center of the rear side 24. Although the middle slit 26 functions to allow natural hair of the user to extend out through it, both slits 26, 28 also function to attach the foundation 22 to the head H.

At the bottom of the bottom slit 28 and along the bottom edge 30 of the rear side 24, three small but strong rubber bands 32 (e.g., 5 mm. in diameter) are provided. These rubber bands 32 can be the same as those used in the orthodontics industry. In addition, two of the same small rubber bands 34 are provided around the middle slit 26. Therefore, in order to increase the tightness of the weave on the head H, a total of five rubber bands 32, 34 can be attached on the edges of the slits 26, 28. The top edge 36 of the foundation 22 is surrounded by about twelve of the same small rubber bands 38, which can be separated from each other by a distance of about three-quarters of an inch. Extending from the top edge 36 of the foundation 22 to the location of the bottom slit 28, an additional seven small slits 40 can be provided along each of the left edge 42 and the right edge 44. Each of these small slits 40 can have a length or width of about 30 mm, and a height of about 10 mm. A small rubber band 46 (which can be the same as the rubber bands 32, 34, 38) can be attached to each corresponding small slit 40 adjacent the left edge 42 and the right edge 44. Therefore, in this embodiment, the foundation 22 has sixteen slits 26, 28, 40, and is surrounded by a total of about twenty-nine rubber bands 32, 38, 46, in addition to two rubber bands 34 in the middle, for a grand total of about thirty-one small but strong rubber bands having a diameter of 5.0 mm or less.

The foundation 22 also includes a plurality of wefts of hair 23 that are attached to the foundation 22.

The method of attaching the hair piece 20 to the head H is illustrated in connection with FIGS. 1-3.

To begin with, the user should match his or her hair to the texture and color of the hair extension that is to be used.

In the first step, the hair is prepared. Specifically, the user's original hair is sectioned into fourteen parts, beginning with a U shape, on the crown of the head H, as shown in FIG. 3, with the fourteen parts corresponding to the sections A, B1-B7 and C1-C6 shown in FIG. 3. Section A is the section of natural hair that remains underneath the hair piece 20. Sections B1-B7 are thin sections of hair located at the outer border of section A, but still under the hair piece 20. Sections C1-C6 are sections of hair used to cover the hair piece 20. This U shape allows for wide styling flexibility of the crown, with the natural front hairline. Dart clips, butterfly clips, or rubber bands can be used to hold sections of the user's natural hair in place while the hair piece 20 is being applied.

In the second step, the hair piece 20 is applied. As described above, the hair piece 20 comes with small but strong rubber bands 32, 34, 38, 46, with the small size of each rubber band increasing the discretion of the attach (i.e., only two winds of the rubber band around the tiny strand of hair). Beginning at the top center of section A, the first two rubber bands 38 are each tied to a tiny strand of hair located just in front of it, from sections B1 and B2, and remain under the hair piece 20, with section A. Then the remaining hair, from sections B1 and B2, between these two rubber bands 38 are pulled out from underneath the hair piece 20, and placed above it to be blended with the hair piece. This process will be repeated for each rubber band 38, 46 and 32 from section B1 chronologically to section B7. The slits 40 and 28 provide the hair stylist with an easy access to the strands of hair from the corresponding section of hair B3-B7.

In the third step, after the rubber bands 46 of sections B3 and B4 have been tied up, the section of hair which will remain underneath the hair piece 20 (section A) can be pulled out of the middle slit 26, thereby blending the natural hair to ensure a seamless and believable look. Then, the rubber bands 34 of the middle slit 26 are tied up.

In the fourth step, the rubber bands 46 along sections B5 and B6 are each tied to a tiny strand of hair located just in front of it, followed by the rubber bands 32 along section B7.

The fifth step applies a finishing look. After the last section B7 has been attached by tying the rubber bands 32 of the rear bottom slit 28, the sections of natural hair used to cover the hairpiece (sections C1 to C6) are blended with the hair piece 20 to ensure a more seamless and believable look. Finally, the user can comb out and style.

The removal time for removing the hair piece 20 is about 10 minutes, and is as simple as unknotting the two twists of each rubber band. Another benefit of this method is that it does not damage the natural hair and actually helps in the growing process of the hair. The use of the rubber bands 32, 34, 38, 46 provides a method of attachment that decreases the thickness of the weave on the head H, because cornrows are not needed as sawing support to attach the weave. This method also provides additional tightness to the overall hair weave because the rubber bands 34 of the middle slit 26 attach the foundation 22 on the head H. Finally, this method offers more discretion because the attachment points are disconnected from each other, and hidden under the wefts of hair 23, which gives the attachment zones a natural effect.

Figure 4:
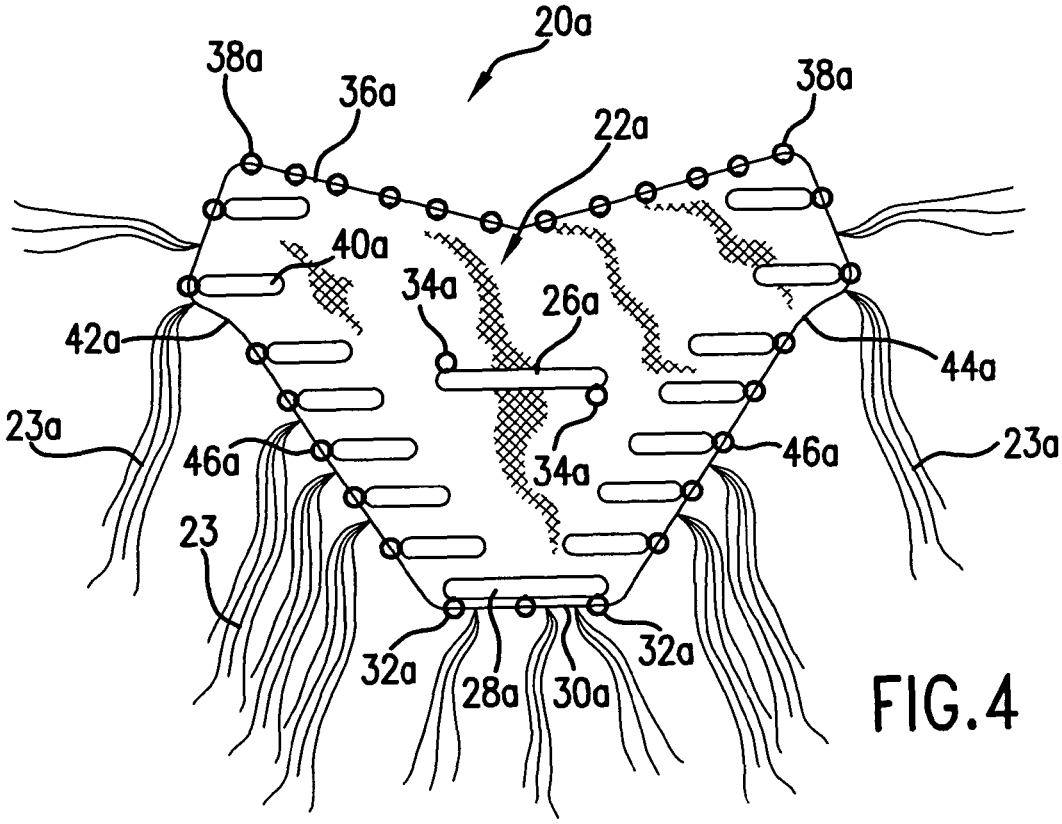
FIG. 4 is a front plan view of a hair piece according to another embodiment of the present invention.
Figure 5:
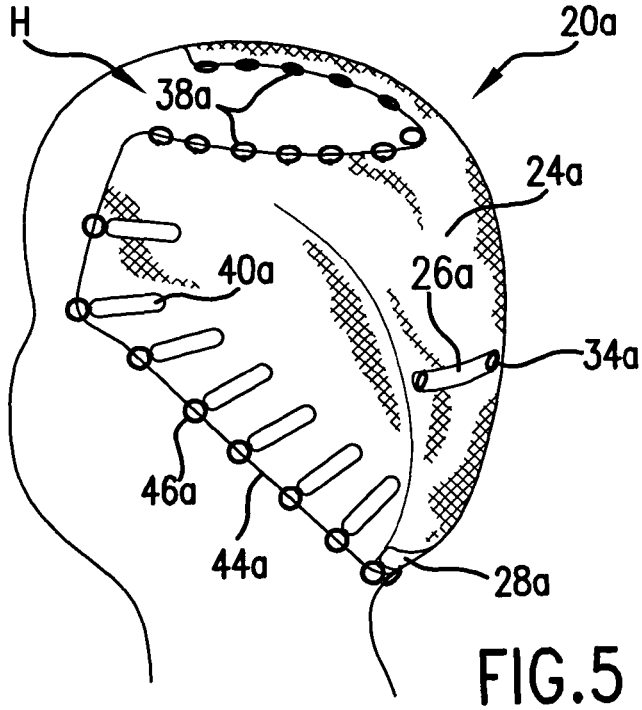
FIG. 5 illustrates the hair piece of FIG. 4 attached on a head, with the wefts of hair being omitted.
Figure 6:
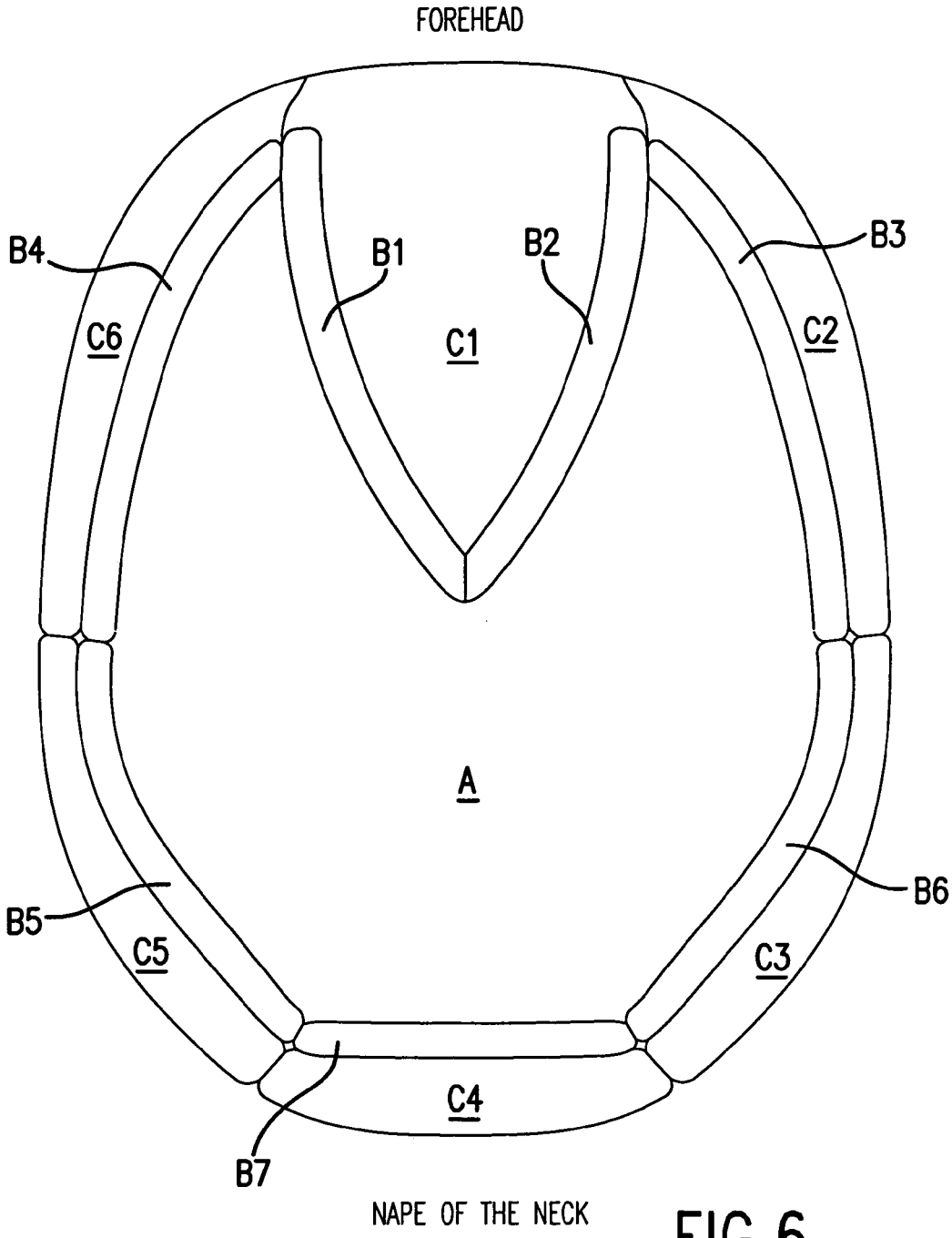
FIG. 6 is a schematic view of a head showing a plurality of sections of the user's hair to position the hair piece of FIG. 4.

FIGS. 4-6 illustrate another embodiment of the present invention, with a hair piece 20*a* that is the same as the hair piece 20 except that it is shaped as a V instead of a U. Otherwise, the construction and features of the hair piece 20*a* is the same as for the hair piece 20, and the method of applications are also the same, so no further description will be provided except that all the numeral designations in FIGS. 4-5 are the same as the numeral designations in FIGS. 1-2 except that an "a" has been added to the corresponding designations in FIGS. 4-5. In addition, the sections A, B1-B7 and C1-C6 in FIG. 6 are similar to the same sections in FIG. 3.

Figure 7:
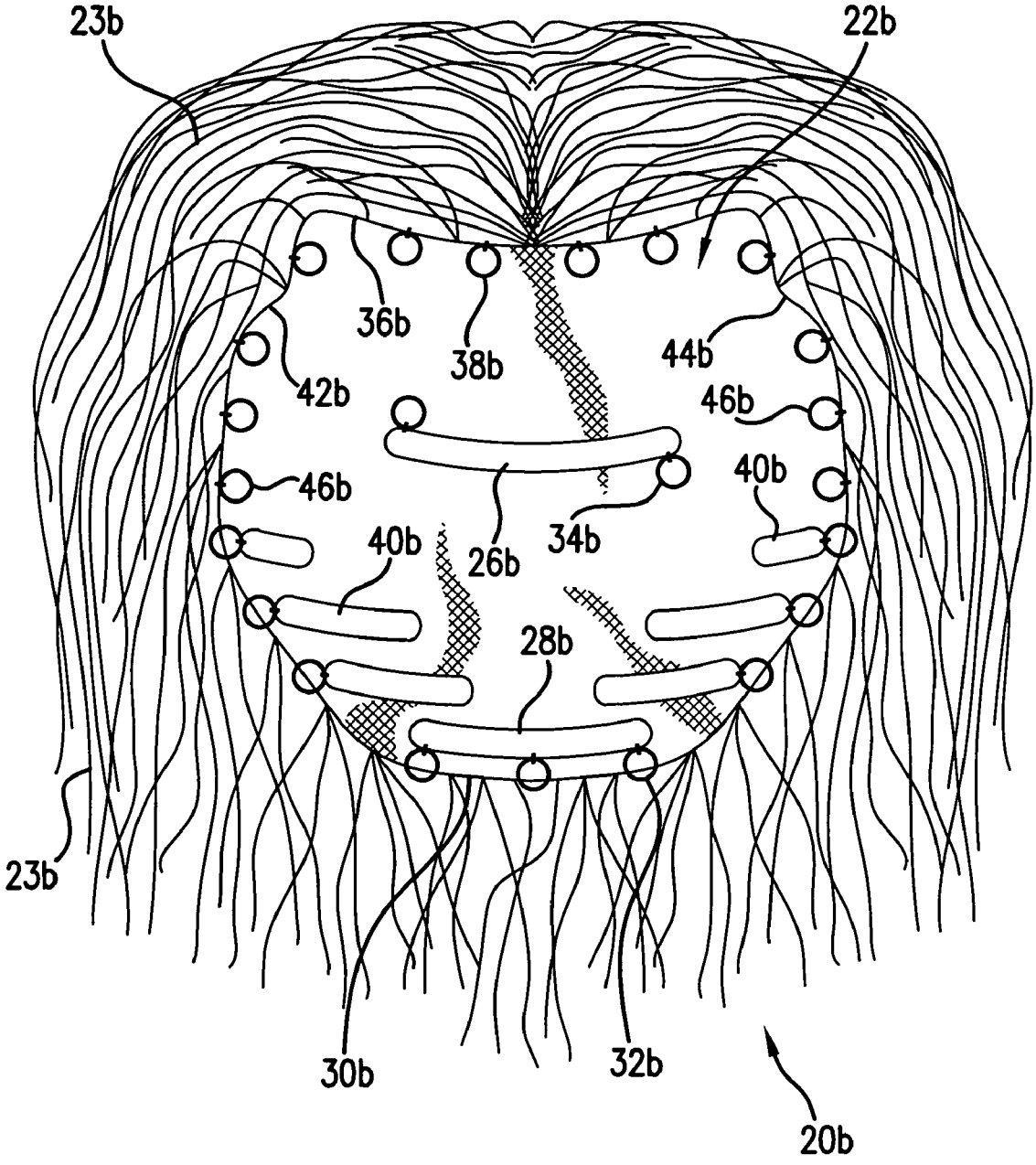
FIG. 7 is a front plan view of a hair piece according to yet another embodiment of the present invention.
Figure 8:
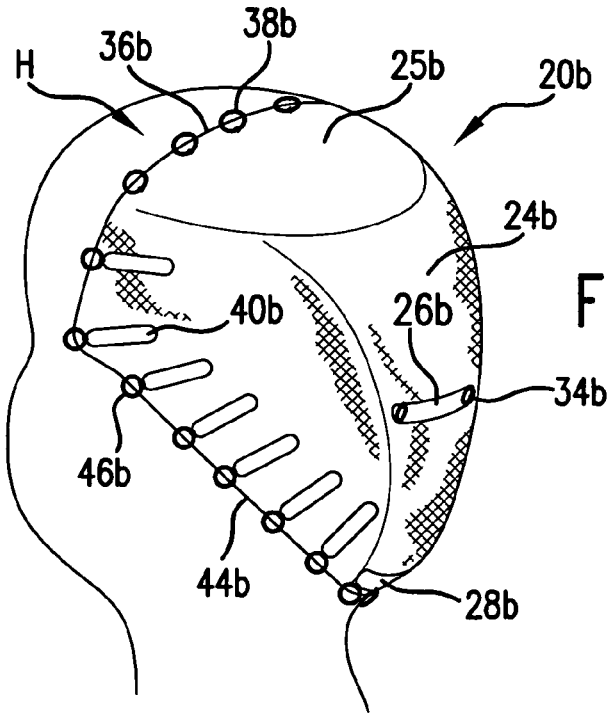
FIG. 8 illustrates the hair piece of FIG. 7 attached on a head, with the wefts of hair being omitted.
Figure 9:
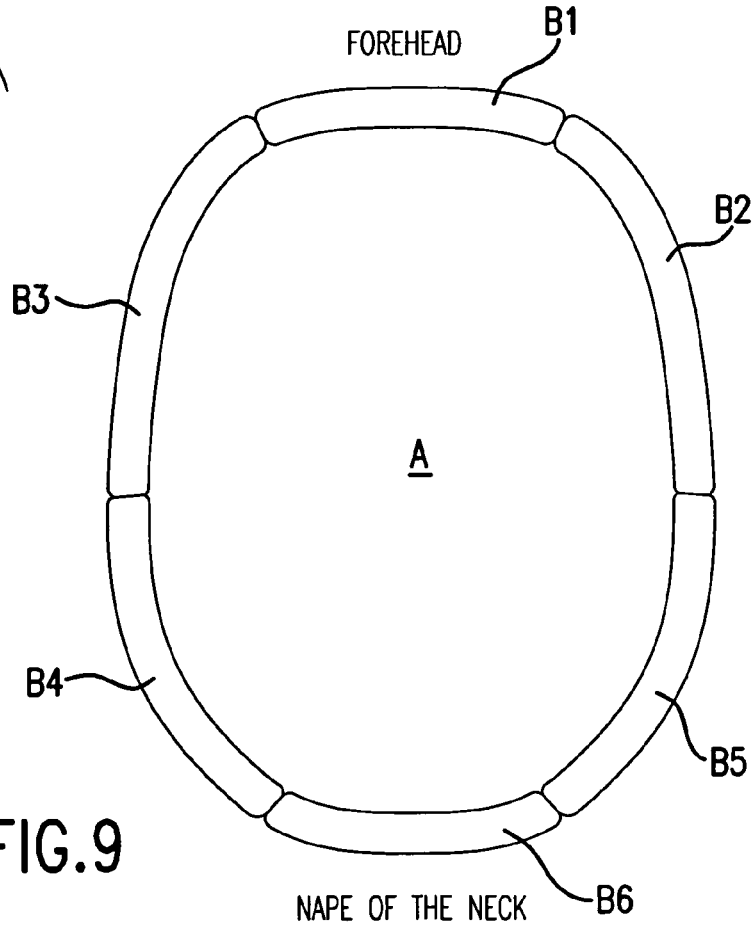
FIG. 9 is a schematic view of a head showing a plurality of sections of the user's hair to position the hair piece of FIG. 7.

FIGS. 7-9 illustrate another embodiment of the present invention, with a hair piece 20*b* that is the same as the hair piece 20 except that it has a different shape. Otherwise, the construction and features of the hair piece 20*b* is the same as for the hair piece 20, and the method of applications are also the same, so all the numeral designations in FIGS. 7-8 are the same as the numeral designations in FIGS. 1-2 except that a "b" has been added to the corresponding designations in FIGS. 7-8. The hair piece 20*b* provides a full-weave foundation 22*b* in that it also includes a top side 25*b* that is adapted to cover the top of the head H. The top edge 36*b* extends to the forehead of the head H, and about four rubber bands 38*b* are provided along the top edge 36*b*. The rubber bands 38*b* are behind the natural front hairline, and are separated from each other by a distance of about three-quarters of an inch. As with the other hair pieces 20 and 20*a*, seven small slits 40*b* extend from the top edge 36*b* to the bottom slit 28*b* along each of the left edge 42*b* and the right edge 44*b*. Therefore, the full weave foundation 22*b* is surrounded by a total of about twenty-one rubber bands 32*b*, 38*b*, 46*b*, with two rubber bands 34*b* in the middle, for a grand total of about twenty-three rubber bands, and sixteen slits 26*b*, 28*b*, 40*b*. The use of rubber bands in this embodiment provides a method of attachment that is very strong, and offers more discretion because the attachment points are hidden under the full weave foundation 22*b*.

The method of attaching the hair piece 20*b* to the head H is illustrated in connection with FIGS. 7-9.

To begin with, if the user plans to stick part of his or her natural hair out of the middle slit 26*b*, the user should match his or her hair to the texture and color of the hair extension to be used.

In the first step, the hair is prepared. Specifically, the user's original hair is sectioned into seven parts, beginning by tracing a line all around the head, behind the natural hairline, as shown in FIG. 9, with the seven parts corresponding to the sections A and B1-B6 shown in FIG. 9. Dart clips, butterfly clips, or rubber bands can be used to hold sections of the user's natural hair in place while the hair piece 20*b* is being applied.

In the second step, the hair piece 20*b* is applied. Beginning at the top center of section A, the first two rubber bands 38 are each tied to a tiny strand of hair located just in front of it, from section B1. Make sure that the remaining hair between the two rubber bands stays underneath the foundation 22*b*. This is repeated for each rubber band 38*b*, 46*b* and 32*b* from section B1 chronologically to section B6.

In the third step, after the rubber bands 46*b* of sections B2 and B3 have been tied up, the rubber bands 34*b* of the middle slit 26*b* are tied up to the section of hair that will remain underneath the foundation 22*b* (section A). Then, the rubber bands 46*b* facing sections B4 and B5 are tied up, followed by tying up the rubber bands 32*b* of the bottom slit 28*b* and the rubber bands 46*b* of section B6.

The fourth step applies a finishing look. After the last section (section B6) has been attached, the user combs out the hair piece 20*b* and styles.

Again, the removal time is about 10 minutes, and can be as simple as unknotting the two twists of the rubber band. Another benefit of this method is that it does not damage the natural hair and actually helps in the growing process.

Figure 10:
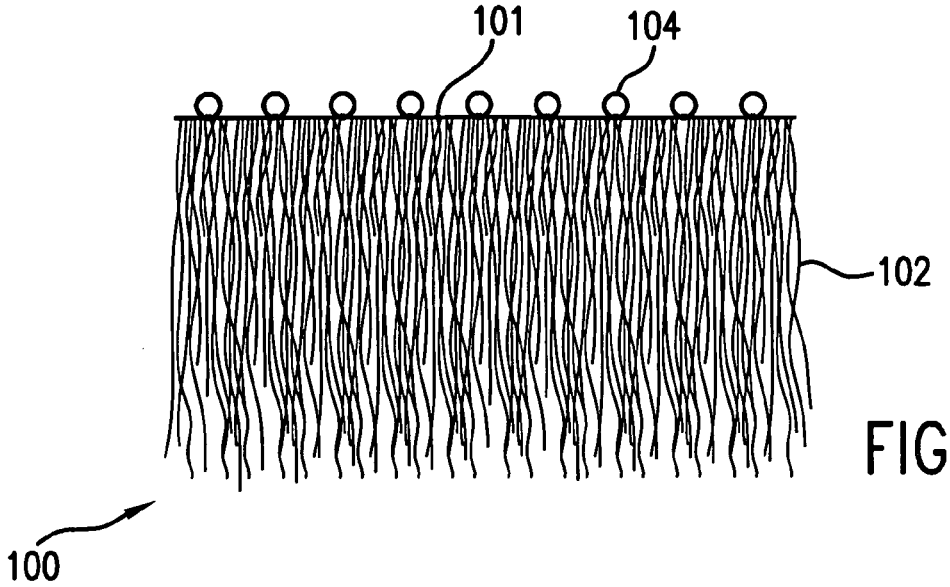
FIG. 10 is a front plan view of a hair extension according to an embodiment of the present invention.

FIG. 10 illustrates a hair extension 100 according to the present invention. The hair extension 100 has a foundation 101 that includes wefts of hair 102 attached to it, and having a plurality of rubber bands 104 aligned in a row that are used to attach the hair extension 100 to the user's head. The rubber bands 104 can be the same as the rubber bands described above (e.g., 5 mm in diameter), and can be spaced-apart from each other by about three-quarters of an inch. The use of the rubber bands 104 provides a method of attachment that is strong, and offers more discretion because the attachment points are hidden under the strands of hair.

Figure 11:
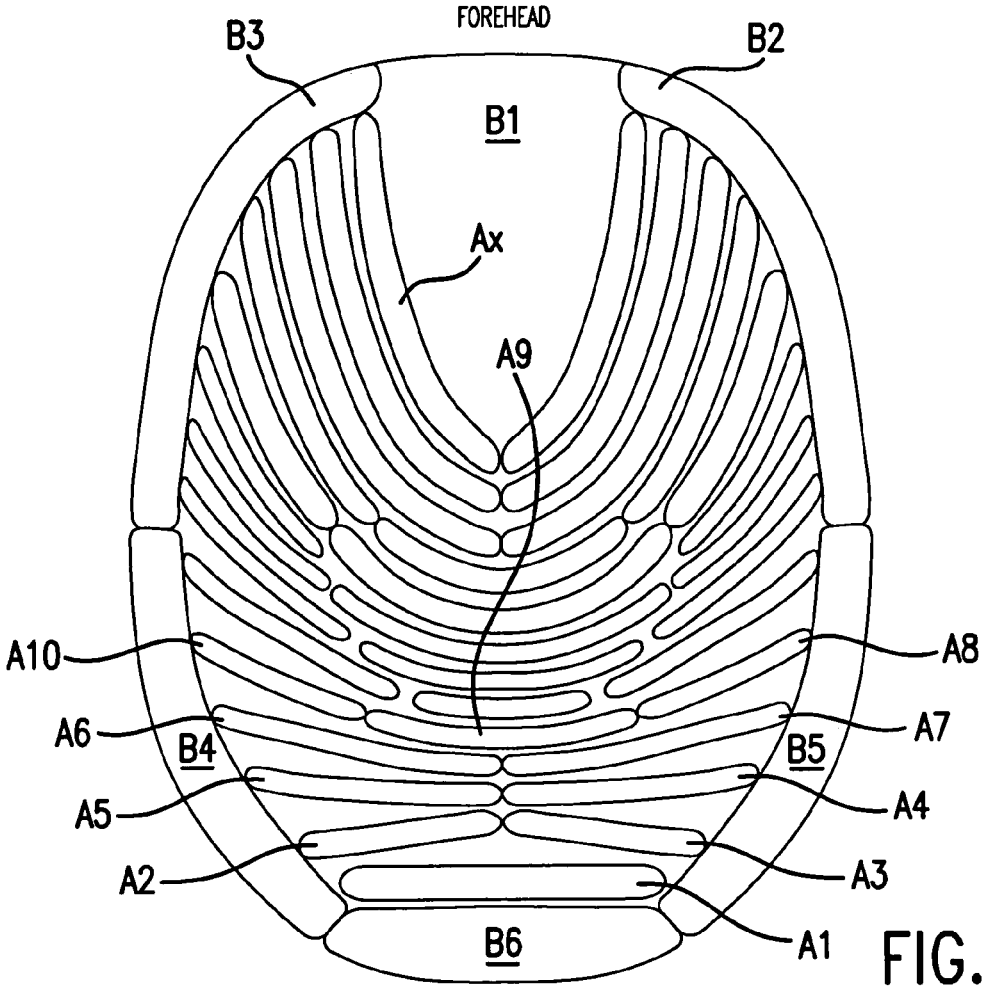
FIG. 11 is a schematic view of a head showing a pattern that can be used for attaching the hair extension of FIG. 10.

The method of attaching the hair extension 100 to the head H is illustrated in connection with FIGS. 10-11.

To begin with, the user should match his or her hair to the texture and color of the hair extension 100 to be used.

In the first step, the hair is prepared. Specifically, the user's original hair is sectioned in a pattern, according to the desired styling finish. FIG. 11 illustrates a V-shaped pattern that can be used with multiple parts corresponding to sections A1-Ax and B1-B6. Sections A1-Ax are sections of natural hair that have been sectioned into a V-shaped pattern, while B1-B6 are sections of hair used to cover the hair extension 100. This is merely an illustrative pattern, as almost any pattern can be selected by the stylist or user. Dart clips, butterfly clips, or rubber bands can be used to hold sections of the user's natural hair in place while the hair extension 100 is being applied.

In the second step, the hair extension 100 is applied. Beginning at the nape of the neck, from the left (or right) of the first section A1, the first two rubber bands 104 are tied to a tiny strand of hair, located just in front of it. The remaining hair is then pulled between the two rubber bands 104, from underneath the hair extension 100. This last sequence is repeated after attaching each additional rubber band.

In this regard, the hair extension 100 can be packaged and sold in the form of a long strip of the hair extension100, and the user will need to cut it to the desired length. The application to each section of the hair extension 100 should begin and end with a rubber band 104. The stylist will use caution to remove any overhanging part of the hair extension 100 at the beginning and at the end of a row attached to a section.

After the hair extension 100 has been attached to the last section of the pattern (e.g., pattern shown in FIG. 11), the sections of the user's natural hair that is used to cover the hairpiece (e.g., the outer sections, around the natural hairline B1-B6) are blended with the hair extension 100 to ensure a more seamless and believable look. The user then combs out and styles.

The removal time for this process is about 10 minutes, and is as simple as unknotting the two twists of the rubber band 104.

Thus, the present invention provides hair pieces 20, 20*a*, 20*b* and 100, and simple methods to attach these hair pieces on to the head that can be used to add length, volume, highlights, and bangs. These hair pieces can also be re-used. The hair extension methods of the present invention not only reduce the extension application time to thirty minutes or less, but also provides a foundation 22, 22*a*, 22*b* with small but strong rubber bands attached to it. The methods do not require any braiding, sewing, taping, heating, gluing, clipping or other special equipment or hardware, and are well-suited for a full head of natural hair that can tend to be bulky beneath a weave, when cornrows are used. The methods of the present invention can also be used with a large variety of hair styles, including short, medium, long, or very long hair, while still allowing their weaves to lay flat and smooth.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A hair piece, comprising a cloth-based foundation having a top edge, a bottom edge, a left edge and a right edge, with the foundation including:

a middle slit provided at about the center of the foundation, a bottom slit provided adjacent the bottom edge, a first set of side slits provided along the left edge, a second set of side slits provided along the right edge, a first set of rubber bands attached along the left edge, a second set of rubber bands attached along the right edge, a third set of rubber bands attached along the top edge, a fourth set of rubber bands attached along the bottom edge, a fifth set of rubber bands attached about the middle slit, and a plurality of wefts of hair attached to the foundation.

2. The hair piece of claim 1, wherein the foundation has a U-shape.

3. The hair piece of claim 1, wherein the first set of slits has seven slits.

4. The hair piece of claim 3, wherein the second set of slits has seven slits.

5. The hair piece of claim 1, wherein each rubber band in the first set of rubber bands is positioned adjacent a corresponding slit of the first set of slits.

6. The hair piece of claim 5, wherein each rubber band in the second set of rubber bands is positioned adjacent a corresponding slit of the second set of slits.

7. The hair piece of claim 1, wherein the total number of rubber bands in the fourth and fifth set of rubber bands is at least four.

8. The hair piece of claim 1, wherein the foundation has a V-shape.

9. A method of attaching a hair piece to the head of a user, comprising:

providing a hair piece comprising a cloth-based foundation having a top edge, a bottom edge, a left edge and a right edge, with the foundation including a middle slit provided at about the center of the foundation, a bottom slit provided adjacent the bottom edge, a first set of side slits provided along the left edge, a second set of side slits provided along the right edge, a first set of rubber bands provided along the left edge, a second set of rubber bands provided along the right edge, a third set of rubber bands provided along the top edge, a fourth set of rubber bands provided along the bottom edge, a fifth set of rubber bands provided about the middle slit, and a plurality of wefts of hair attached to the foundation;

sectioning the user's hair into a plurality of sections;

applying the hair piece to the head;

tying the rubber bands in the upper half of the first and second sets of rubber bands, and the rubber bands of the third set of rubber bands, to a strand of hair from the corresponding sections of hair and pulling out sections of hair through the first and second sets of slits;

pulling the section of hair which will remain underneath the hair piece out of the middle slit;

tying the rubber bands in the lower half of the first and second sets of rubber bands, and the rubber bands of the fifth set of rubber bands, to a strand of hair from the corresponding sections of hair;

tying the rubber bands in the fourth set of rubber bands to the corresponding sections of hair; and blending the sections of natural hair with the hair piece.

* * * * *